US008028438B2

(12) United States Patent
Pedtke

(10) Patent No.: US 8,028,438 B2
(45) Date of Patent: Oct. 4, 2011

(54) MOISTURE CONDENSATION CONTROL SYSTEM

(75) Inventor: William Scott Pedtke, Evansville, IN (US)

(73) Assignee: Aqualizer, LLC, Evansville, IN (US)

( * ) Notice: Subject to any disclaimer, the term of this patent is extended or adjusted under 35 U.S.C. 154(b) by 819 days.

(21) Appl. No.: 11/630,907

(22) PCT Filed: Jun. 30, 2005

(86) PCT No.: PCT/US2005/023112

§ 371 (c)(1),
(2), (4) Date: Dec. 27, 2006

(87) PCT Pub. No.: WO2006/014293

PCT Pub. Date: Feb. 9, 2006

(65) Prior Publication Data

US 2009/0193822 A1 Aug. 6, 2009

Related U.S. Application Data

(60) Provisional application No. 60/584,888, filed on Jul. 2, 2004.

(51) Int. Cl.
*F26B 25/00* (2006.01)

(52) U.S. Cl. ..... 34/223; 34/102; 34/553; 34/90; 34/130; 62/80; 62/456; 134/79; 134/187; 126/110 R; 137/204; 417/454; 106/222

(58) Field of Classification Search ..... 34/223, 34/102, 553, 90, 130; 62/80, 456; 106/222; 417/454; 137/204; 126/110 R; 134/79, 134/187

See application file for complete search history.

(56) References Cited

U.S. PATENT DOCUMENTS

| | | | | | |
|---|---|---|---|---|---|
| 1,470,306 | A | * | 10/1923 | Walsh | 34/403 |
| 1,565,772 | A | * | 12/1925 | Barrus | 34/119 |
| 1,675,285 | A | * | 6/1928 | Vance | 34/205 |
| 1,737,259 | A | * | 11/1929 | Miller | 34/471 |
| 1,753,828 | A | * | 4/1930 | Greer et al. | 34/223 |
| 1,811,107 | A | * | 6/1931 | Barnebey | 34/449 |
| 1,889,761 | A | * | 12/1932 | Schlesinger | 34/58 |
| 1,932,830 | A | * | 10/1933 | Puening | 34/102 |
| 1,953,160 | A | * | 4/1934 | Fuke | 34/130 |
| 2,074,455 | A | * | 3/1937 | Carleton | 34/553 |
| 2,080,421 | A | * | 5/1937 | Hickman | 417/152 |
| 2,081,128 | A | * | 5/1937 | Volpin | 62/80 |
| 2,101,840 | A | * | 12/1937 | Dinley | 134/60 |
| 2,116,862 | A | * | 5/1938 | Dinley | 134/107 |
| 2,166,539 | A | * | 7/1939 | Briscoe | 106/222 |
| 2,171,921 | A | * | 9/1939 | Duval et al. | 34/530 |
| 2,199,815 | A | * | 5/1940 | Flosdorf | 34/76 |
| 2,225,774 | A | * | 12/1940 | Flosdorf | 34/292 |
| 2,263,067 | A | * | 11/1941 | Burggrabe | 62/142 |
| 2,297,094 | A | * | 9/1942 | Armstrong et al. | 34/124 |

(Continued)

FOREIGN PATENT DOCUMENTS

DE 3151874 A1 * 7/1983

(Continued)

*Primary Examiner* — Steve Gravini
(74) *Attorney, Agent, or Firm* — Barnes & Thornburg

(57) ABSTRACT

A moisture control system generally comprising a collector element is configured to be incorporated into a structure to control moisture condensation on the interior and exterior of the structure. The collector element encourages condensation on its surface. The control system includes a channel in fluid communication with the collector element to direct the condensed liquid away from the control element.

20 Claims, 2 Drawing Sheets

U.S. PATENT DOCUMENTS

| | | | | | |
|---|---|---|---|---|---|
| 2,313,707 | A | * | 3/1943 | Lithgow et al. | 62/456 |
| 2,317,520 | A | * | 4/1943 | Coons | 62/85 |
| 2,330,040 | A | * | 9/1943 | Fitch | 137/80 |
| 2,379,436 | A | * | 7/1945 | Hickman et al. | 417/54 |
| 2,385,151 | A | * | 9/1945 | Miller | 91/38 |
| 2,399,996 | A | * | 5/1946 | Fitch | 137/204 |
| 2,403,218 | A | * | 7/1946 | Hanners | 123/41.26 |
| 2,422,536 | A | * | 6/1947 | Finnegan | 34/77 |
| 2,469,435 | A | * | 5/1949 | Hirsch | 96/146 |
| 2,489,009 | A | * | 11/1949 | Corhanidis | 62/281 |
| 2,508,132 | A | * | 5/1950 | Aikman | 137/195 |
| 2,512,897 | A | * | 6/1950 | David | 34/76 |
| 2,515,098 | A | * | 7/1950 | Smith, Jr. | 34/290 |
| 2,539,407 | A | * | 1/1951 | Dinley | 34/74 |
| 2,553,452 | A | * | 5/1951 | Guthrie | 34/540 |
| 2,557,621 | A | * | 6/1951 | Touborg | 34/402 |
| 2,565,767 | A | * | 8/1951 | Gaskell, Jr. | 62/7 |
| 2,569,261 | A | * | 9/1951 | Sehwarzkopf | 34/69 |
| 2,570,808 | A | * | 10/1951 | Hermes | 34/555 |
| 2,574,911 | A | * | 11/1951 | Cowburn | 34/171 |
| 2,576,578 | A | * | 11/1951 | Dalrymple | 137/565.18 |
| 2,608,769 | A | * | 9/1952 | O'Neil | 34/131 |
| 2,644,245 | A | * | 7/1953 | Hammell et al. | 34/547 |
| 2,651,113 | A | * | 9/1953 | Milby et al. | 34/78 |
| 2,673,835 | A | * | 3/1954 | Kearney | 134/79 |
| 2,680,915 | A | * | 6/1954 | Smith | 34/75 |
| 2,680,916 | A | * | 6/1954 | Smith | 34/75 |
| 2,682,088 | A | * | 6/1954 | Schuh | 34/239 |
| 2,706,346 | A | * | 4/1955 | Smith | 34/75 |
| 2,717,456 | A | * | 9/1955 | Smith | 34/75 |
| 2,717,457 | A | * | 9/1955 | Smith | 34/75 |
| 2,722,057 | A | * | 11/1955 | Pugh | 34/74 |
| 2,723,109 | A | * | 11/1955 | Kirkpatrick | 165/302 |
| 2,731,732 | A | * | 1/1956 | Harris, Jr. et al. | 34/422 |
| 2,743,533 | A | * | 5/1956 | Smith | 34/547 |
| 2,767,558 | A | * | 10/1956 | Wallenbrock et al. | 62/276 |
| 2,775,020 | A | * | 12/1956 | Boyes | 34/619 |
| 2,797,559 | A | * | 7/1957 | Atchison | 62/280 |
| 2,806,297 | A | * | 9/1957 | Hutchins | 34/173 |
| 2,833,056 | A | * | 5/1958 | Smith | 34/527 |
| 2,867,748 | A | * | 1/1959 | Van Atta et al. | 315/5.42 |
| 2,882,705 | A | * | 4/1959 | Shortland | 66/19 |
| 2,893,135 | A | * | 7/1959 | Smith | 34/610 |
| 2,903,367 | A | * | 9/1959 | Grindrod | 426/316 |
| 2,920,399 | A | * | 1/1960 | Fry, Jr. | 34/647 |
| 2,931,708 | A | * | 4/1960 | Aamot | 75/10.29 |
| 2,932,091 | A | * | 4/1960 | Day | 34/124 |
| 2,941,389 | A | * | 6/1960 | Morrison | 68/20 |
| 2,950,731 | A | * | 8/1960 | Heintzelman | 137/183 |
| 2,985,967 | A | * | 5/1961 | Pataillot et al. | 34/608 |
| 2,995,828 | A | * | 8/1961 | Brown et al. | 34/92 |
| 3,022,581 | A | * | 2/1962 | Smith | 34/75 |
| 3,027,653 | A | * | 4/1962 | Long et al. | 34/86 |
| 3,029,525 | A | * | 4/1962 | Pinder | 34/75 |
| 3,032,887 | A | * | 5/1962 | Whyte et al. | 34/524 |
| 3,043,015 | A | * | 7/1962 | Brucken | 34/80 |
| 3,046,163 | A | * | 7/1962 | Kearney et al. | 134/11 |
| 3,082,543 | A | * | 3/1963 | Julian | 34/191 |
| 3,218,727 | A | * | 11/1965 | Lind | 34/287 |
| 3,239,948 | A | * | 3/1966 | Di Mino | 34/657 |
| 3,242,587 | A | * | 3/1966 | Dupasquier | 34/60 |
| 3,290,793 | A | * | 12/1966 | Jacobs et al. | 34/76 |
| 3,302,303 | A | * | 2/1967 | Aupoix | 34/145 |
| 3,321,843 | A | * | 5/1967 | Taran | 34/596 |
| 3,328,894 | A | * | 7/1967 | Smith, Jr. | 34/583 |
| 3,358,471 | A | * | 12/1967 | Butcher et al. | 62/339 |
| 3,382,586 | A | * | 5/1968 | Lorentzen | 34/92 |
| 3,383,878 | A | * | 5/1968 | Booth | 62/281 |
| 3,397,116 | A | * | 8/1968 | Bourland | 202/177 |
| 3,405,452 | A | * | 10/1968 | Candor et al. | 34/251 |
| 3,413,728 | A | * | 12/1968 | Tiegel et al. | 34/443 |
| 3,431,657 | A | * | 3/1969 | Dufour | 34/209 |
| 3,447,511 | A | * | 6/1969 | Beard et al. | 123/3 |
| 3,448,527 | A | * | 6/1969 | Hernandez, Jr. | 34/289 |
| 3,450,192 | A | * | 6/1969 | Hay | 165/49 |
| 3,464,186 | A | * | 9/1969 | Walker et al. | 96/115 |
| 3,470,848 | A | * | 10/1969 | Dreher | 118/50 |
| 3,479,746 | A | * | 11/1969 | Bahmsen | 34/418 |
| 3,484,949 | A | * | 12/1969 | Aronoff | 34/635 |
| 3,491,456 | A | * | 1/1970 | Candor et al. | 34/251 |
| 3,498,069 | A | * | 3/1970 | Waldin | 62/63 |
| RE26,950 | E | * | 9/1970 | Hays | 15/321 |
| 3,543,408 | A | * | 12/1970 | Candor et al. | 34/250 |
| 3,546,783 | A | * | 12/1970 | Candor et al. | 34/250 |
| 3,563,305 | A | * | 2/1971 | Hay | 165/49 |
| 3,648,379 | A | * | 3/1972 | Mercer et al. | 34/284 |
| 3,648,381 | A | * | 3/1972 | Fox | 34/82 |
| 3,660,910 | A | * | 5/1972 | Evans et al. | 34/60 |
| 3,667,130 | A | * | 6/1972 | Candor et al. | 34/250 |
| 3,687,821 | A | * | 8/1972 | Zalles | 203/86 |
| 3,690,635 | A | * | 9/1972 | Harker et al. | 266/149 |
| 3,707,185 | A | * | 12/1972 | Modine et al. | 165/111 |
| 3,710,450 | A | * | 1/1973 | Figiel | 34/337 |
| 3,710,453 | A | * | 1/1973 | Whelpley | 34/164 |
| 3,757,426 | A | * | 9/1973 | Candor et al. | 34/251 |
| 3,783,265 | A | * | 1/1974 | Carr | 362/485 |
| 3,795,986 | A | * | 3/1974 | Sutherland et al. | 34/92 |
| 3,802,216 | A | * | 4/1974 | Brandimarte | 62/262 |
| 3,828,501 | A | * | 8/1974 | Haskins | 52/302.4 |
| 3,831,292 | A | * | 8/1974 | DePas | 34/75 |
| 3,839,803 | A | * | 10/1974 | Dick | 34/203 |
| 3,858,330 | A | * | 1/1975 | De Pas | 34/75 |
| 3,859,004 | A | * | 1/1975 | Condit | 34/75 |
| 3,872,924 | A | * | 3/1975 | Clampitt | 166/261 |
| 3,875,679 | A | * | 4/1975 | Condit | 34/75 |
| 3,875,681 | A | * | 4/1975 | De Pas | 34/75 |
| 3,889,389 | A | * | 6/1975 | Serup | 34/412 |
| 3,903,958 | A | * | 9/1975 | Hay | 165/50 |
| 3,908,752 | A | * | 9/1975 | Padden | 165/247 |
| 3,922,797 | A | * | 12/1975 | Dick | 34/432 |
| 3,931,683 | A | * | 1/1976 | Crites et al. | 34/169 |
| 3,933,342 | A | * | 1/1976 | Schramm | 266/154 |
| 3,942,323 | A | * | 3/1976 | Maillet | 60/413 |
| 3,958,628 | A | * | 5/1976 | Padden | 165/222 |
| 3,973,477 | A | * | 8/1976 | Jakob et al. | 454/184 |
| 3,986,274 | A | * | 10/1976 | Holm | 34/653 |
| 4,008,729 | A | * | 2/1977 | Chizinsky | 134/107 |
| 4,033,048 | A | * | 7/1977 | Van Ike | 34/92 |
| 4,062,489 | A | * | 12/1977 | Henderson | 237/1 R |
| 4,064,796 | A | * | 12/1977 | Jones | 99/330 |
| 4,073,097 | A | * | 2/1978 | Jentoft et al. | 52/22 |
| 4,089,916 | A | * | 5/1978 | Hay | 261/153 |
| 4,109,395 | A | * | 8/1978 | Huang | 34/93 |
| 4,120,289 | A | * | 10/1978 | Bottum | 126/586 |
| 4,125,947 | A | * | 11/1978 | Mamistov et al. | 34/108 |
| 4,132,010 | A | * | 1/1979 | Deland | 34/60 |
| 4,142,487 | A | * | 3/1979 | Somraty | 123/73 B |
| 4,166,096 | A | * | 8/1979 | Gillis et al. | 422/119 |
| 4,194,949 | A | * | 3/1980 | Stark | 202/180 |
| 4,203,422 | A | * | 5/1980 | Bottum | 126/572 |
| 4,210,121 | A | * | 7/1980 | Stark | 126/573 |
| 4,220,138 | A | * | 9/1980 | Bottum | 126/590 |
| 4,224,925 | A | * | 9/1980 | Movick | 126/614 |
| 4,235,677 | A | * | 11/1980 | Karamian | 202/176 |
| 4,237,965 | A | * | 12/1980 | Hay | 165/48.2 |
| 4,249,516 | A | * | 2/1981 | Stark | 126/601 |
| 4,269,170 | A | * | 5/1981 | Guerra | 126/619 |
| 4,292,121 | A | * | 9/1981 | Caffes | 159/3 |
| 4,302,887 | A | * | 12/1981 | Johnson | 34/389 |
| 4,312,181 | A | * | 1/1982 | Clark | 60/519 |
| 4,313,423 | A | * | 2/1982 | Mahdjuri | 126/637 |
| 4,313,457 | A | * | 2/1982 | Cliff | 137/312 |
| 4,326,344 | A | * | 4/1982 | Smith | 34/566 |
| 4,331,128 | A | * | 5/1982 | Gebhardt | 126/621 |
| 4,348,818 | A | * | 9/1982 | Brown | 34/77 |
| 4,355,522 | A | * | 10/1982 | Gorski et al. | 62/340 |
| 4,393,817 | A | * | 7/1983 | Lindberg | 123/3 |
| 4,402,315 | A | * | 9/1983 | Tsuda et al. | 128/200.18 |
| 4,408,425 | A | | 10/1983 | Torme | |
| 4,409,931 | A | * | 10/1983 | Lindberg | 123/25 R |
| 4,415,024 | A | * | 11/1983 | Baker | 165/160 |
| 4,425,906 | A | * | 1/1984 | Ingestrom | 126/613 |
| 4,426,213 | A | * | 1/1984 | Stavropoulos | 55/466 |
| 4,430,861 | A | * | 2/1984 | Avery | 60/675 |
| 4,444,217 | A | * | 4/1984 | Cummings et al. | 137/195 |
| 4,450,855 | A | * | 5/1984 | Hills | 137/312 |
| 4,486,208 | A | * | 12/1984 | Stavropoulos | 55/466 |

4,506,851 A * 3/1985 Gupta et al. ..... 244/129.1
4,515,134 A * 5/1985 Warren, II ..... 123/557
4,541,367 A * 9/1985 Lindberg ..... 123/25 M
4,542,734 A * 9/1985 Trent et al. ..... 126/110 R
4,543,734 A * 10/1985 Smith ..... 34/284
4,548,262 A 10/1985 Hull
4,556,049 A * 12/1985 Tchernev ..... 126/628
4,562,855 A * 1/1986 Cummings et al. ..... 137/195
4,571,850 A * 2/1986 Hunt et al. ..... 34/242
4,574,829 A * 3/1986 Cummings et al. ..... 137/195
4,588,443 A * 5/1986 Bache ..... 106/644
4,619,054 A * 10/1986 Sato ..... 34/92
4,627,176 A * 12/1986 Brieu ..... 34/115
4,646,713 A * 3/1987 Honigsbaum ..... 126/79
4,649,898 A * 3/1987 Martinson ..... 126/369
4,671,076 A * 6/1987 Duren ..... 62/289
4,680,905 A 7/1987 Rockar
4,757,618 A * 7/1988 Mihalov ..... 34/73
4,802,286 A * 2/1989 Kobayashi et al. ..... 34/289
4,862,526 A * 9/1989 Berger ..... 4/536
4,899,726 A * 2/1990 Waterman ..... 126/110 R
4,908,047 A * 3/1990 Leonard ..... 95/71
4,922,839 A * 5/1990 Boucher ..... 110/234
4,951,661 A * 8/1990 Sladek ..... 128/202.27
4,955,372 A * 9/1990 Blackmer et al. ..... 128/203.16
5,003,774 A * 4/1991 Leonard ..... 96/52
5,007,804 A * 4/1991 Boucher ..... 417/209
5,010,660 A * 4/1991 Hambleton et al. ..... 34/92
5,020,237 A * 6/1991 Gross et al. ..... 34/265
5,038,529 A * 8/1991 Conley et al. ..... 52/14
5,060,482 A * 10/1991 Jackson ..... 62/610
5,060,686 A * 10/1991 Troy ..... 137/171
5,117,563 A * 6/1992 Castonguay ..... 34/86
5,125,167 A * 6/1992 Stearns ..... 34/77
5,125,230 A * 6/1992 Leonard ..... 60/274
5,136,792 A * 8/1992 Janecke ..... 34/78
5,174,042 A * 12/1992 Tomizawa et al. ..... 34/259
5,195,332 A * 3/1993 Sullivan ..... 62/291
5,199,185 A * 4/1993 Davidson ..... 34/250
5,199,385 A * 4/1993 Doss ..... 122/14.22
5,207,074 A * 5/1993 Cox et al. ..... 62/285
5,217,860 A * 6/1993 Fahy et al. ..... 435/1.2
5,226,242 A * 7/1993 Schwenkler ..... 34/78
5,251,541 A * 10/1993 Anson et al. ..... 99/280
5,279,047 A * 1/1994 Janecke ..... 34/78
5,305,533 A * 4/1994 Alexander et al. ..... 34/549
5,320,682 A * 6/1994 Good et al. ..... 134/38
5,321,896 A * 6/1994 Brownewell et al. ..... 34/247
5,325,601 A * 7/1994 Brownewell et al. ..... 34/247
5,333,394 A * 8/1994 Herdeman et al. ..... 34/467
5,335,425 A * 8/1994 Tomizawa et al. ..... 34/265
5,343,630 A * 9/1994 Ferguson, Sr. ..... 34/319
5,347,980 A * 9/1994 Shellenberger ..... 126/110 R
5,369,964 A * 12/1994 Mauer et al. ..... 62/420
5,423,485 A * 6/1995 Tagusari ..... 239/121
5,454,390 A * 10/1995 Lawson et al. ..... 134/105
5,472,876 A * 12/1995 Fahy ..... 435/284.1
5,473,910 A * 12/1995 Atterbury et al. ..... 62/323.1
5,475,926 A * 12/1995 Bolkestein et al. ..... 34/200
5,551,845 A * 9/1996 Milam ..... 417/290
5,553,391 A * 9/1996 Bakalar ..... 34/110
5,553,392 A * 9/1996 Hanaya ..... 34/115
5,555,732 A * 9/1996 Whiticar ..... 62/3.4
5,586,549 A * 12/1996 Hartenstine et al. ..... 126/635
5,628,122 A * 5/1997 Spinardi ..... 34/79
5,647,141 A * 7/1997 Hanaya ..... 34/115
5,660,167 A * 8/1997 Ryder ..... 128/200.21
5,671,544 A * 9/1997 Yokomizo et al. ..... 34/78
5,673,496 A * 10/1997 Wegner et al. ..... 34/471
5,687,678 A * 11/1997 Suchomel et al. ..... 122/250 R
5,693,537 A * 12/1997 Wilson et al. ..... 435/401
5,707,869 A * 1/1998 Wolf et al. ..... 435/401
5,709,038 A * 1/1998 Scheufler et al. ..... 34/475
5,711,981 A * 1/1998 Wilson et al. ..... 426/511
5,718,061 A * 2/1998 Scheufler et al. ..... 34/475
5,720,576 A * 2/1998 Scuero ..... 405/116
5,727,332 A * 3/1998 Thrasher et al. ..... 34/277
5,765,380 A * 6/1998 Misawa et al. ..... 62/210
5,766,561 A * 6/1998 Frieze et al. ..... 422/297
5,769,628 A * 6/1998 Lin ..... 432/241
5,813,222 A * 9/1998 Appleby ..... 60/274
5,839,206 A * 11/1998 Lisson et al. ..... 34/132
5,845,485 A * 12/1998 Murphy et al. ..... 60/274
5,862,612 A * 1/1999 Bielfeldt ..... 34/398
5,878,925 A * 3/1999 Denkins et al. ..... 222/608
5,894,735 A * 4/1999 Misawa et al. ..... 62/177
5,915,811 A * 6/1999 DeVore et al. ..... 34/93
5,953,908 A * 9/1999 Appleby ..... 60/275
5,964,043 A * 10/1999 Oughton et al. ..... 34/92
5,964,089 A * 10/1999 Murphy et al. ..... 60/286
5,964,985 A * 10/1999 Wootten ..... 201/40
5,966,835 A * 10/1999 Bakalar ..... 34/267
5,966,952 A * 10/1999 Misawa et al. ..... 62/159
5,970,625 A * 10/1999 Scheufler et al. ..... 34/477
5,976,005 A * 11/1999 Wilson et al. ..... 452/173
5,979,673 A * 11/1999 Dooley ..... 211/41.11
5,983,919 A * 11/1999 Ottinger et al. ..... 137/195
5,992,048 A * 11/1999 DeVore et al. ..... 34/522
5,996,248 A * 12/1999 Coppa et al. ..... 34/417
6,013,158 A * 1/2000 Wootten ..... 202/99
6,019,033 A * 2/2000 Wilson et al. ..... 99/470
6,026,588 A * 2/2000 Clark et al. ..... 34/77
6,035,551 A * 3/2000 Scheufler et al. ..... 34/475
6,036,827 A * 3/2000 Andrews et al. ..... 204/252
6,044,575 A * 4/2000 Marschke ..... 34/124
6,047,936 A * 4/2000 Favotto et al. ..... 248/309.1
6,053,003 A * 4/2000 Song et al. ..... 62/285
6,065,223 A * 5/2000 Gode ..... 34/168
6,074,200 A * 6/2000 Bowman et al. ..... 431/278
6,098,343 A 8/2000 Brown et al.
6,102,066 A * 8/2000 Craig et al. ..... 137/312
6,113,255 A * 9/2000 Shalit ..... 362/576
6,122,909 A * 9/2000 Murphy et al. ..... 60/286
6,139,311 A * 10/2000 Bowman et al. ..... 431/278
6,161,302 A * 12/2000 Rantala ..... 34/119
6,167,717 B1 * 1/2001 Dudley et al. ..... 62/291
6,196,015 B1 * 3/2001 Pignolo ..... 62/285
6,230,501 B1 * 5/2001 Bailey et al. ..... 62/51.1
6,235,254 B1 * 5/2001 Murphy et al. ..... 423/212
6,279,593 B1 * 8/2001 Sheppard ..... 137/1
6,280,623 B1 * 8/2001 Ma ..... 210/264
6,291,003 B1 * 9/2001 Riemann et al. ..... 426/511
6,302,122 B1 * 10/2001 Parker et al. ..... 132/333
6,305,180 B1 * 10/2001 Miller et al. ..... 62/259.2
6,311,409 B1 * 11/2001 Coppa et al. ..... 34/92
6,363,736 B1 * 4/2002 Kunkel et al. ..... 62/291
6,385,978 B1 * 5/2002 Elliott ..... 62/93
6,427,449 B1 * 8/2002 Logan et al. ..... 62/3.4
6,427,639 B1 * 8/2002 Andrews et al. ..... 123/3
6,430,841 B1 * 8/2002 Borkowski et al. ..... 34/557
6,443,164 B1 * 9/2002 Parker et al. ..... 132/333
6,443,173 B1 * 9/2002 Thompson, Jr. ..... 137/1
6,464,854 B2 * 10/2002 Andrews et al. ..... 205/628
6,470,592 B2 * 10/2002 Akimoto et al. ..... 34/92
6,477,786 B1 * 11/2002 Jones et al. ..... 34/228
6,546,848 B2 * 4/2003 Ehlhardt et al. ..... 99/403
6,554,608 B1 * 4/2003 Bowman et al. ..... 431/6
6,560,893 B1 * 5/2003 Bakalar ..... 34/110
6,574,979 B2 * 6/2003 Faqih ..... 62/285
6,576,137 B1 * 6/2003 Ma ..... 210/657
6,582,743 B2 * 6/2003 Cai ..... 426/510
6,584,995 B2 * 7/2003 Kimbrough et al. ..... 137/240
6,619,289 B1 * 9/2003 Mashak ..... 128/205.28
6,634,576 B2 * 10/2003 Verhoff et al. ..... 241/21
6,658,764 B2 * 12/2003 Hsu ..... 34/468
6,684,648 B2 * 2/2004 Faqih ..... 62/93
6,684,878 B2 * 2/2004 Ho et al. ..... 126/110 R
6,688,018 B2 * 2/2004 Soucy ..... 34/68
6,698,389 B2 * 3/2004 Andrews et al. ..... 123/41.31
6,729,041 B2 * 5/2004 Shindo et al. ..... 34/444
6,735,883 B1 * 5/2004 Bria et al. ..... 34/444
6,748,741 B2 * 6/2004 Martin et al. ..... 60/605.2
6,769,483 B2 * 8/2004 de Rouffignac et al. ..... 166/60
6,775,925 B2 * 8/2004 Zagar et al. ..... 34/618
6,782,947 B2 * 8/2004 de Rouffignac et al. ..... 166/245
6,796,127 B2 * 9/2004 Helm ..... 60/712
6,804,949 B2 * 10/2004 Andrews et al. ..... 60/272
6,865,825 B2 * 3/2005 Bailey et al. ..... 36/88

6,868,690 B2 * 3/2005 Faqih ..... 62/291
6,877,555 B2 * 4/2005 Karanikas et al. ..... 166/245
6,880,633 B2 * 4/2005 Wellington et al. ..... 166/245
6,905,645 B2 * 6/2005 Iskra ..... 264/128
6,915,850 B2 * 7/2005 Vinegar et al. ..... 166/272.2
6,918,442 B2 * 7/2005 Wellington et al. ..... 166/245
6,918,443 B2 * 7/2005 Wellington et al. ..... 166/245
6,921,680 B2 * 7/2005 Robbins ..... 438/51
6,923,257 B2 * 8/2005 Wellington et al. ..... 166/245
6,929,067 B2 * 8/2005 Vinegar et al. ..... 166/302
6,931,756 B2 * 8/2005 Morgan et al. ..... 34/202
6,932,155 B2 * 8/2005 Vinegar et al. ..... 166/245
6,945,063 B2 * 9/2005 Max ..... 62/235.1
6,948,562 B2 * 9/2005 Wellington et al. ..... 166/272.1
6,951,247 B2 * 10/2005 de Rouffignac et al. ..... 166/245
6,953,401 B2 * 10/2005 Starr ..... 472/65
6,964,300 B2 * 11/2005 Vinegar et al. ..... 166/245
6,966,374 B2 * 11/2005 Vinegar et al. ..... 166/272.3
6,969,123 B2 * 11/2005 Vinegar et al. ..... 299/3
6,976,367 B2 * 12/2005 Spanger ..... 62/129
6,981,548 B2 * 1/2006 Wellington et al. ..... 166/245
6,986,654 B2 * 1/2006 Imiolek et al. ..... 425/182
6,991,032 B2 * 1/2006 Berchenko et al. ..... 166/245
6,991,033 B2 * 1/2006 Wellington et al. ..... 166/245
6,991,036 B2 * 1/2006 Sumnu-Dindoruk et al. 166/302
6,991,045 B2 * 1/2006 Vinegar et al. ..... 175/45
6,994,169 B2 * 2/2006 Zhang et al. ..... 166/302
6,996,334 B1 * 2/2006 Parsons et al. ..... 392/386
6,997,518 B2 * 2/2006 Vinegar et al. ..... 299/5
7,004,247 B2 * 2/2006 Cole et al. ..... 166/60
7,004,251 B2 * 2/2006 Ward et al. ..... 166/245
7,008,209 B2 * 3/2006 Iskra et al. ..... 425/182
7,011,154 B2 * 3/2006 Maher et al. ..... 166/245
7,013,972 B2 * 3/2006 Vinegar et al. ..... 166/257
7,020,986 B1 * 4/2006 Nakai et al. ..... 34/596
7,024,104 B2 * 4/2006 Moore et al. ..... 392/379
7,027,887 B2 * 4/2006 Gaylo et al. ..... 700/117
7,032,406 B2 * 4/2006 Hollen et al. ..... 62/347
7,032,660 B2 * 4/2006 Vinegar et al. ..... 166/245
7,040,397 B2 * 5/2006 de Rouffignac et al. ..... 166/245
7,040,398 B2 * 5/2006 Wellington et al. ..... 166/245
7,040,399 B2 * 5/2006 Wellington et al. ..... 166/245
7,040,400 B2 * 5/2006 de Rouffignac et al. ..... 166/245
7,043,853 B2 * 5/2006 Roberts et al. ..... 34/73
7,047,752 B2 * 5/2006 Salt et al. ..... 62/121
7,051,807 B2 * 5/2006 Vinegar et al. ..... 166/245
7,051,808 B1 * 5/2006 Vinegar et al. ..... 166/250.1
7,051,811 B2 * 5/2006 de Rouffignac et al. ..... 166/302
7,055,262 B2 * 6/2006 Goldberg et al. ..... 34/86
7,055,600 B2 * 6/2006 Messier et al. ..... 166/250.01
7,063,145 B2 * 6/2006 Veenstra et al. ..... 166/250.01
7,066,254 B2 * 6/2006 Vinegar et al. ..... 166/245
7,066,257 B2 * 6/2006 Wellington et al. ..... 166/272.2
7,073,442 B2 * 7/2006 Fedor et al. ..... 101/480
7,073,578 B2 * 7/2006 Vinegar et al. ..... 166/245
7,077,198 B2 * 7/2006 Vinegar et al. ..... 166/245
7,077,199 B2 * 7/2006 Vinegar et al. ..... 166/250.01
7,086,465 B2 * 8/2006 Wellington et al. ..... 166/272.1
7,090,013 B2 * 8/2006 Wellington ..... 166/267
7,096,942 B1 * 8/2006 de Rouffignac et al. ..... 166/245
7,100,541 B2 * 9/2006 Frasure et al. ..... 122/159
7,100,994 B2 * 9/2006 Vinegar et al. ..... 299/7
7,104,319 B2 * 9/2006 Vinegar et al. ..... 166/245
7,107,701 B2 * 9/2006 Takemura et al. ..... 34/526
7,107,706 B1 * 9/2006 Bailey et al. ..... 36/88
7,114,566 B2 * 10/2006 Vinegar et al. ..... 166/256
7,115,227 B2 * 10/2006 Mucciardi et al. ..... 266/225
7,121,341 B2 * 10/2006 Vinegar et al. ..... 166/302
7,121,342 B2 * 10/2006 Vinegar et al. ..... 166/302
7,128,153 B2 * 10/2006 Vinegar et al. ..... 166/285
7,156,176 B2 * 1/2007 Vinegar et al. ..... 166/302
7,165,615 B2 * 1/2007 Vinegar et al. ..... 166/302
7,191,546 B2 * 3/2007 Maruca ..... 34/201
7,204,041 B1 * 4/2007 Bailey et al. ..... 36/29
7,219,734 B2 * 5/2007 Bai et al. ..... 166/302
7,225,866 B2 * 6/2007 Berchenko et al. ..... 166/245
RE39,720 E * 7/2007 Murphy et al. ..... 60/286
7,251,906 B2 * 8/2007 Kajihara et al. ..... 34/603
7,263,850 B2 * 9/2007 Eom et al. ..... 62/286
7,264,179 B2 * 9/2007 Robbins ..... 239/398
7,285,352 B2 * 10/2007 Yoshimoto et al. ..... 429/38
7,337,955 B1 * 3/2008 Block et al. ..... 235/379
7,353,989 B1 * 4/2008 Block et al. ..... 235/379
7,357,307 B1 * 4/2008 Block et al. ..... 235/379
7,360,588 B2 * 4/2008 Vinegar et al. ..... 166/59
7,374,669 B2 * 5/2008 Zinn ..... 210/138
7,377,052 B2 * 5/2008 Maruca ..... 34/201
7,437,834 B2 * 10/2008 Nakatsukasa et al. ..... 34/381
7,441,412 B2 * 10/2008 Jensen ..... 62/121
7,451,750 B1 * 11/2008 Fox et al. ..... 123/568.12
7,461,691 B2 * 12/2008 Vinegar et al. ..... 166/60
7,513,132 B2 * 4/2009 Wright et al. ..... 68/18 F
7,513,420 B1 * 4/2009 Block et al. ..... 235/379
7,534,304 B2 * 5/2009 Conrad et al. ..... 134/10
7,562,509 B2 * 7/2009 Ness ..... 52/800.11
7,571,866 B2 * 8/2009 Buswell et al. ..... 239/373
7,578,932 B2 * 8/2009 Cantolino ..... 210/124
7,600,672 B2 * 10/2009 Scanlon ..... 235/379
7,640,980 B2 * 1/2010 Vinegar et al. ..... 166/268
7,641,105 B2 * 1/2010 Scanlon ..... 235/379
7,658,321 B1 * 2/2010 Greco et al. ..... 235/379
7,662,864 B2 * 2/2010 Kanamathareddy et al. ..... 514/772.5
7,735,935 B2 * 6/2010 Vinegar et al. ..... 299/5
7,735,945 B1 * 6/2010 Sliwa et al. ..... 347/6
7,757,499 B2 * 7/2010 Jensen ..... 62/121
7,785,098 B1 * 8/2010 Appleby et al. ..... 425/470
7,794,450 B2 * 9/2010 Blott et al. ..... 604/543
7,798,746 B2 * 9/2010 Byles ..... 405/45
7,829,708 B2 * 11/2010 Roberts et al. ..... 544/283
7,857,806 B2 * 12/2010 Karpowicz et al. ..... 604/540
7,861,921 B1 * 1/2011 Steinbach et al. ..... 235/379
7,891,546 B1 * 2/2011 Steinbach et al. ..... 235/375
7,893,413 B1 * 2/2011 Appleby et al. ..... 250/505.1
7,896,228 B1 * 3/2011 Motz et al. ..... 235/375
7,934,643 B1 * 5/2011 Crews et al. ..... 235/379
2002/0011075 A1 * 1/2002 Faqih ..... 62/285
2002/0046569 A1 * 4/2002 Faqih ..... 62/188
2002/0050072 A1 * 5/2002 Akimoto et al. ..... 34/92
2002/0070124 A1 * 6/2002 Andrews et al. ..... 205/628
2002/0073715 A1 * 6/2002 Logan et al. ..... 62/3.4
2002/0112738 A1 * 8/2002 Parker et al. ..... 132/333
2002/0121302 A1 * 9/2002 Thompson, Jr. ..... 137/204
2002/0124582 A1 * 9/2002 Oakner et al. ..... 62/150
2002/0157705 A1 * 10/2002 Schlensker et al. ..... 137/187
2002/0166546 A1 * 11/2002 Andrews et al. ..... 123/556
2002/0178932 A1 * 12/2002 Cai ..... 99/516
2003/0010381 A1 * 1/2003 Kimbrough et al. ..... 137/240
2003/0029323 A1 * 2/2003 Ehlhardt et al. ..... 99/330
2003/0070672 A1 * 4/2003 Ho et al. ..... 126/110 R
2003/0079363 A1 * 5/2003 Soucy ..... 34/60
2003/0085135 A1 * 5/2003 Andrews et al. ..... 205/637
2003/0097763 A1 * 5/2003 Morgan et al. ..... 34/468
2003/0115768 A1 * 6/2003 Hoffman ..... 34/92
2003/0129782 A1 * 7/2003 Robbins ..... 438/48
2003/0145481 A1 * 8/2003 Zagar et al. ..... 34/83
2003/0159457 A1 * 8/2003 Faqih ..... 62/285
2003/0208922 A1 * 11/2003 Hsu ..... 34/468
2004/0040305 A1 * 3/2004 Helm ..... 60/712
2004/0079079 A1 * 4/2004 Martin et al. ..... 60/605.2
2004/0110057 A1 * 6/2004 Yoshimoto et al. ..... 429/38
2004/0117919 A1 * 6/2004 Conrad et al. ..... 8/137
2004/0134213 A1 * 7/2004 Dudley et al. ..... 62/285
2004/0139555 A1 * 7/2004 Conrad et al. ..... 8/137
2004/0139626 A1 * 7/2004 Takemura et al. ..... 34/448
2004/0168339 A1 * 9/2004 Roberts et al. ..... 34/218
2004/0193100 A1 * 9/2004 Van Hooser et al. ..... 604/35
2004/0193101 A1 * 9/2004 Van Hooser et al. ..... 604/35
2004/0221595 A1 * 11/2004 Hille et al. ..... 62/244
2004/0226934 A1 * 11/2004 Moore et al. ..... 219/401
2005/0066538 A1 * 3/2005 Goldberg et al. ..... 34/218
2005/0077660 A1 * 4/2005 Mucciardi et al. ..... 266/223
2005/0091755 A1 * 5/2005 Conrad et al. ..... 8/137
2005/0091756 A1 * 5/2005 Wright et al. ..... 8/137
2005/0092352 A1 * 5/2005 Luckman et al. ..... 134/42
2005/0101393 A1 * 5/2005 Starr ..... 472/65
2005/0109054 A1 * 5/2005 Eom et al. ..... 62/286
2005/0109287 A1 * 5/2005 Frasure et al. ..... 122/18.1

| | | | | |
|---|---|---|---|---|
| 2005/0138939 | A1* | 6/2005 | Spanger | 62/150 |
| 2005/0150059 | A1* | 7/2005 | Luckman et al. | 8/137 |
| 2005/0155393 | A1* | 7/2005 | Wright et al. | 68/3 R |
| 2005/0160620 | A1* | 7/2005 | Morgan et al. | 34/469 |
| 2005/0166613 | A1* | 8/2005 | Oakner et al. | 62/150 |
| 2005/0178848 | A1* | 8/2005 | Robbins | 239/10 |
| 2005/0278972 | A1* | 12/2005 | Maruca | 34/201 |
| 2006/0026985 | A1* | 2/2006 | Hollen et al. | 62/340 |
| 2006/0037213 | A1* | 2/2006 | Kajihara et al. | 34/596 |
| 2006/0102746 | A1* | 5/2006 | Buswell et al. | 239/373 |
| 2006/0120700 | A1* | 6/2006 | Moore et al. | 392/386 |
| 2006/0144399 | A1* | 7/2006 | Davidowski et al. | 128/205.12 |
| 2006/0174506 | A1* | 8/2006 | McDonald | 34/72 |
| 2006/0179676 | A1* | 8/2006 | Goldberg et al. | 34/77 |
| 2006/0201023 | A1* | 9/2006 | Burke | 34/573 |
| 2006/0237373 | A1* | 10/2006 | Zinn | 210/741 |
| 2006/0272174 | A1* | 12/2006 | Hartig | 34/475 |
| 2006/0272633 | A1* | 12/2006 | Osias, Jr. | 126/383.1 |
| 2006/0275721 | A1* | 12/2006 | Starr et al. | 431/125 |
| 2007/0028640 | A1* | 2/2007 | Hampton | 62/280 |
| 2007/0028777 | A1* | 2/2007 | Hoffman et al. | 96/143 |
| 2007/0056715 | A1* | 3/2007 | Mucciardi et al. | 165/104.26 |
| 2007/0062464 | A1* | 3/2007 | Frasure et al. | 122/13.01 |
| 2007/0074602 | A1* | 4/2007 | Mucciardi et al. | 75/533 |
| 2007/0144032 | A1* | 6/2007 | Maruca | 34/469 |
| 2007/0151604 | A1* | 7/2007 | Platusich et al. | 137/178 |
| 2007/0204853 | A1* | 9/2007 | Cheng et al. | 126/299 D |
| 2007/0204855 | A1* | 9/2007 | Cheng et al. | 126/299 D |
| 2007/0245591 | A1* | 10/2007 | Gens et al. | 34/443 |
| 2007/0261415 | A1* | 11/2007 | Barnes | 62/5 |
| 2008/0000252 | A1* | 1/2008 | Lee et al. | 62/291 |
| 2008/0022550 | A1* | 1/2008 | Masters | 34/480 |
| 2008/0072892 | A1* | 3/2008 | Wawrla et al. | 126/307 R |
| 2008/0154543 | A1* | 6/2008 | Rajagopal et al. | 702/183 |
| 2008/0184589 | A1* | 8/2008 | Shivvers | 34/504 |
| 2008/0216503 | A1* | 9/2008 | Cantolino | 62/285 |
| 2008/0245091 | A1* | 10/2008 | Logsdon | 62/285 |
| 2008/0314375 | A1* | 12/2008 | Khan | 126/116 R |
| 2009/0020166 | A1* | 1/2009 | McHugh, IV | 137/314 |
| 2009/0079255 | A1* | 3/2009 | DuBrucq | 299/4 |
| 2009/0139513 | A1* | 6/2009 | Davis | 126/615 |
| 2009/0151191 | A1* | 6/2009 | Grunert | 34/480 |
| 2009/0172967 | A1* | 7/2009 | Son et al. | 34/318 |
| 2009/0282855 | A1* | 11/2009 | Maples et al. | 62/344 |

FOREIGN PATENT DOCUMENTS

| | | | |
|---|---|---|---|
| DE | 3311077 | A1 * | 10/1984 |
| DE | 3741043 | C1 * | 10/1988 |
| DE | 3811699 | A1 * | 10/1989 |
| DE | 19517533 | A1 * | 11/1996 |
| DE | 10207552 | C1 * | 7/2003 |
| EP | 63964 | A2 * | 11/1982 |
| EP | 623699 | A1 * | 11/1994 |
| EP | 889288 | A1 * | 1/1999 |
| EP | 1245902 | A1 * | 10/2002 |
| EP | 1876397 | A2 * | 1/2008 |
| FR | 2631373 | A1 * | 11/1989 |
| FR | 2631432 | A1 * | 11/1989 |
| FR | 2702345 | A1 * | 9/1994 |
| FR | 2800861 | A1 * | 5/2001 |
| GB | 2067635 | A * | 7/1981 |
| GB | 2070117 | A * | 9/1981 |
| GB | 2085951 | A * | 5/1982 |
| GB | 2088453 | A * | 6/1982 |
| GB | 2102052 | A * | 1/1983 |
| GB | 2131072 | A * | 6/1984 |
| GB | 2149444 | A * | 6/1985 |
| GB | 2170251 | A * | 7/1986 |
| GB | 2209787 | A * | 5/1989 |
| GB | 2211234 | A * | 6/1989 |
| GB | 2228284 | A * | 8/1990 |
| GB | 2230042 | A * | 10/1990 |
| GB | 2231892 | A * | 11/1990 |
| GB | 2281334 | A * | 3/1995 |
| JP | 55046851 | A * | 4/1980 |
| JP | 55108180 | A * | 8/1980 |
| JP | 56127130 | A * | 10/1981 |
| JP | 57042394 | A * | 3/1982 |
| JP | 58047956 | A * | 3/1983 |
| JP | 58069362 | A * | 4/1983 |
| JP | 58072842 | A * | 4/1983 |
| JP | 58175743 | A * | 10/1983 |
| JP | 58178187 | A * | 10/1983 |
| JP | 61057710 | A * | 3/1986 |
| JP | 03282143 | A * | 12/1991 |
| JP | 05187663 | A * | 7/1993 |
| JP | 06034291 | A * | 2/1994 |
| JP | 06257777 | A * | 9/1994 |
| JP | 06307682 | A * | 11/1994 |
| JP | 07229373 | A * | 8/1995 |
| JP | 08322183 | A * | 12/1996 |
| JP | 09159227 | A * | 6/1997 |
| JP | 09318097 | A * | 12/1997 |
| JP | 10238826 | A * | 9/1998 |
| JP | 10268090 | A * | 10/1998 |
| JP | 11108391 | A * | 4/1999 |
| JP | 2000087485 | A * | 3/2000 |
| JP | 2000121259 | A * | 4/2000 |
| JP | 2000213251 | A * | 8/2000 |
| JP | 2004340397 | A * | 12/2004 |
| JP | 2006017366 | A * | 1/2006 |
| JP | 2007130193 | A * | 5/2007 |
| JP | 2007291661 | A * | 11/2007 |
| JP | 2008097497 | A * | 4/2008 |
| WO | WO 8504208 | A1 * | 9/1985 |
| WO | WO 9826233 | A1 * | 6/1998 |
| WO | WO 9906773 | A1 * | 2/1999 |
| WO | WO 9945546 | A1 * | 9/1999 |
| WO | WO 03038362 | A2 * | 5/2003 |
| WO | WO 03078904 | A1 * | 9/2003 |
| WO | WO 03092847 | A2 * | 11/2003 |
| WO | WO 2006014293 | A2 * | 2/2006 |

* cited by examiner

MOISTURE CONDENSATION CONTROL SYSTEM

RELATED APPLICATIONS

This application is a U.S. national counterpart application under 37 C.F.R. §371(b) of PCT international application serial no. PCT/US2005/023112 filed Jun. 30, 2005, which claims the benefit of and priority to U.S. Provisional Application No. 60/584,888, filed Jul. 2, 2004.

FIELD OF THE INVENTION

The present invention relates generally to the control of moisture in a structure, and more specifically to the minimization of moisture condensation on the inside of a structure.

BACKGROUND OF THE INVENTION

Moisture may collect in the cavities of structures, such as for example and without limitation houses, buildings and the like. This moisture may come from capillary transport, such as by wind-driven rain, by rain or other water leaking into the structure, by water vapor diffusion and fluid flows, such as airflow, through the wall(s) of the structure. As used herein, the term fluid refers generally to any substance tending to flow or conform to the outline of its container including any gas, such as for example air, or any liquid, such as for example water. Humidity is the amount of water vapor in the air, with water vapor being the gaseous form of water. Condensation occurs when water vapor changes from a gas to a liquid. Most of the humidity in outside air comes from evaporation of water from bodies of water, and from water vapor emitted by plants and animals. Humidity in air inside a structure is raised by such activities as cooking, bathing, doing laundry, growing plants and the like. The humidity of air inside a structure can be lowered by a dehumidifier and the use of exhaust fans in areas where water vapor is created, or raised by a humidifier. When the humidity inside a structure is greater than 50%, condensation of the water vapor can occur, leading to mold, rot, pest infestation, and the like. When air cools, it loses its ability to "hold" moisture. The dew point is a measure of how much water vapor is actually in the air, whereas the relative humidity is a measure of the amount of water in the air compared with the amount of water the air can hold at a constant pressure and temperature. The dew point is the temperature to which air must be cooled to reach saturation, which is when condensation occurs, whereas the relative humidity is a percentage that indicates how saturated the air is. For example, a relative humidity of 50% means that the air contains half of the amount of moisture needed for saturation.

Generally, the second law of thermodynamics dictates that heat flows spontaneously from a hot body to a cool body. Therefore, a warm fluid, such as air, will move toward a cold body, until an equilibrium is reached. Thus, while relatively warm air outside the structure may move toward relatively cooler air or body inside the structure, referred to herein as infiltration, relatively warm air inside a structure may move toward relatively cooler air or body outside the structure, referred to herein as exfiltration. The relatively cooler walls or structures are exposed to temperature gradients by infiltration and exfiltration. The temperature gradients induce moisture flows, such as for example water vapor and liquid flows. The moisture content and the corresponding relative humidity in the porous materials inside a wall cavity are such that moisture starts redistributing inside the wall to the colder side due to the effects of the temperature gradient. Sinks that attract water vapor include surfaces having a temperature that chills the air coming in contact with the surface to the dew point, thereby causing condensation on the surface.

When relatively warm and humid air encounters a relatively colder surface, such as a window pane, water vapor diffusion may cause condensation on that surface, so long as the dew point temperature exists. Condensation generally may occur when the relative humidity inside the structure is above about 50%. The flow of fluid tends to be toward the coldest point in the structure, which is typically one or more of the windows. Thus, whether the fluid is infiltrating from outside to inside, as on a relatively hot day, or exfiltrating from inside to outside, as on a relatively cold day, condensation may occur on the window(s) and may drip down into the sill, causing damage to the structure.

For example, when conventional window frames and sashes are used in structures in which the temperature inside the structure is greater than the temperature outside the structure, heat transfer from portions of the frame and sash inside the structure may lower the temperature of those portions below the dew point of the air inside the structure, thereby causing moisture condensation on their inside surfaces. Conversely, if the temperature outside the structure is greater than the temperature inside the structure, then the heat transfer may lower the dew point of the air outside the structure, thereby causing moisture condensation on the outside surfaces. Such condensation may facilitate the formation of mold or otherwise cause damage to the structure.

To minimize this objectionable heat transfer, thermal barrier elements having a relatively low coefficient of thermal conductivity are commonly interspaced between inside portions of the window frame and outside portions of the frame. As used herein, the phrase coefficient of thermal conductivity or coefficient of heat conductivity means any coefficient indicating the rate of heat transmission through a given material. Such barriers are not only sometimes difficult to install properly, but do not always sufficiently minimize the heat transfer from the inside frame portions to prevent moisture condensation thereon. It is also possible to control the amount of moisture in the air inside the structure, such as by the use of a dehumidifier. However, a dehumidifier typically requires some type of electrical power to extract the water vapor from the air. What is needed is a generally passive, mechanical system for controlling moisture condensation without the need for any external power to cause or induce condensation.

SUMMARY OF THE INVENTION

The present invention may comprise one or more of the following features and combinations thereof.

The present invention is directed to a moisture condensation control system that can be incorporated into a structure to control moisture condensation on the structure's inside and outside surface(s). As used herein, the term structure refers to a anything that may be used for shelter such as for example and without limitation buildings, houses, garages, warehouses, barns, sheds, caves, cellars, treehouses, hangars, factories, sports arenas, natatoriums, greenhouses and the like. Such control may include minimizing the amount of condensation that occurs as well as where the condensation occurs. The illustrative moisture control device may induce or encourage condensation on a particular surface and thereby retard condensation on other surfaces of the structure.

The illustrative moisture control system or device is a passive, mechanical, self-regulating system that requires no external power to induce or encourage condensation. The illustrative moisture control device generally may comprise a condensation collector element. The condensation collector element may be a generally planar element having a front or obverse surface and a rear or reverse surface opposite the front surface. The collector element may be curvate rather than planar. The collector element may but need not be substantially opaque. The front and rear surfaces may be formed out of any suitable metallic, non-metallic or composite material, or any combination thereof, such as for example and without limitation steel, copper, plastic, ceramic and the like. The chosen material preferably should have heat transmission properties greater than the other structural components of the structure such that the collector element is a better water vapor sink that presents a colder surface relative to the structure's other structural components to thereby better attract and condense water vapor on the collector element. As used herein, structural components generally refers to the walls, ceilings, floors, doors and windows of the structure. Therefore, the collector element should have higher thermal conductivity and lower thermal resistance relative to the structure's other structural components. The collector element surface(s) may be relatively low surface tension and generally hygrophobic surface(s) so that any liquid that has condensed on the collector element will more readily roll off of the collector element surface(s). The collector element may have any thickness so long as the thickness does not create a thermal resistance that will inhibit condensation thereon. The thermal resistance of the collector should be minimal relative to the total resistance of the wall of the structure, it being appreciated that the device may be disposed in the structure without any exterior sheathing where the device is installed. In addition, the device will operate no matter what cladding materials, for example brick, stucco and wood, are used in the structure. In the event that a covering material, such as for example a wall, insulation, a cover, sheathing or the like is placed in front of one or both of the collector surface(s), a thermal bridge may be utilized to ensure that the collector surfaces are in thermal communication with either the ambient atmosphere inside of the structure or the ambient atmosphere outside of the structure, whichever ambient atmosphere is colder relative to the other. One non-exclusive example of a suitable low tension and thermally conductive material is copper. Any other suitable metallic, non-metallic, or composite material may be used including steel, plastic, ceramic, glass or combinations thereof. The moisture control device may further comprise a drainage system. The drainage system may include one or more water collection reservoirs in fluid communication with the collector element. The water collection reservoir(s) collect(s) any moisture that condenses on the surface(s). A single collection reservoir may be in fluid communication with each of the front and the back surfaces, or one collection reservoir may be in fluid communication with the front surface and a second reservoir may be in fluid communication with the rear surface. A pipe, system of pipes, drain or other suitable channel may be in fluid communication with the collection reservoir(s) to transport or carry the collected moisture away from the moisture control device. If the moisture control device is installed in a structure, the drain may transport the collected moisture away from the structure.

The illustrative moisture control device may be installed in any desired structure. The illustrative moisture control device may be installed in an open structure, such as a warehouse, or in a structure having many rooms, such as a house. The moisture control device will work with any type of framing, for example steel or wood frame. The moisture control device may be installed in any combination. For example, it may be installed in a single room of a structure, may be installed in multiple rooms of a structure, and may be installed in combination with other moisture control devices in a single room.

The moisture control device provides an apparatus and method for passively inducing vapor pressure drives toward the collector element, and water condensation on the surface(s) thereof. The collector element blocks the fluid flow and starts condensing water on its surface. If the ambient temperature of the collector surface is above the freezing point of water, then the condensed water begins draining or rolling off of the surface as soon as the water layer thickness on the collector surface becomes great enough to overcome surface tension. If the ambient temperature of the collector surface is below the freezing point of water, then the condensed water is stored on the collector surface as frost and ice, which will melt and roll off the surface as soon as the surface temperature rises above freezing. The condensed water rolls off of the surface(s) and into the water collection reservoir. The channel transports the collected water away from the moisture control device. The operation of the moisture control device reduces the amount of water that would otherwise accumulate in the porous construction materials or condensate on the structure's surfaces thereby resulting in mold growth, rot, corrosion, structural loss of strength, degradation in materials, increases in energy loss and the like.

It will be appreciated that the moisture control device can be placed in many locations in the structure. Illustratively, it may be placed in a structure's wall cavity between the vertical studs in the insulation cavity. The device may be placed at any desired vertical position between the studs. For example, it may be placed at the very top of the vertical studs, generally adjacent the ceiling, at the very bottom of the vertical studs, generally adjacent the floor, or at any intermediate position therebetween. So too, it could be general coextensive with the entire space between the vertical studs and the base and ceiling stud plates from generally adjacent the ceiling to generally adjacent the floor. The moisture control device can also occupy various horizontal positions between the studs. For example, it could be disposed at or near the structure's interior wall, at or near the exterior wall, or at any intermediate position therebetween. In addition, it could have variable positioning such that it can move between a position proximate to the interior wall to a position proximate to the exterior wall and any intermediate position. It may generally be desirable that the device be near the colder side of the wall. Thus, if infiltration is the biggest problem, as is generally the case in areas with hot and humid climates, then the device might be placed near the interior wall of the structure. Conversely, if exfiltration is the biggest problem, as generally the case in areas with cold climates, then the device might be placed near the exterior wall of the structure. Those skilled in the art will appreciate that the collector element might be repositioned within its frame, or the entire system repositioned, accordingly as the prevailing climate changes in those areas whose climate changes with the season. So too, a structure may have more than one moisture control device, with one or more being disposed near the interior wall and one or more being disposed near the exterior wall as desired. Illustratively, the moisture control system could be installed in reverse, such that the internal surface is facing outwardly from the interior of the structure and the external surface is facing inwardly toward the interior of the surface, especially if the position of the collector element is adjustable toward and away from the interior of the structure.

It may be desirable to have an airgap between the collector's surface(s) and any covering material positioned in front of the collector's surface(s). As noted, such material may include a wall, sheathing, insulation, a curtain, a cover, and the like. The thickness of such an airgap may range from about 2.5 mm to about 9.5 mm. Tests have shown that fluid is more efficiently removed by the collector element if the airgap is between about 8.5 mm to about 9.5 mm, preferably about 9.0 mm.

A collector element may be incorporated between a first vertical stud and a second vertical stud of the structure's wall stud construction. A flange may be attached to the first and second vertical studs and an air-tight seal may be disposed between a border of the flange and at least a portion of the periphery or the perimeter of the collector element. The border of the flange may further include a lower channel having a drain opening disposed therein. The channel is designed to control and direct any moisture from the system. Additional collector element(s) may be incorporated between additional studs, or a single element may span in excess of two vertical spans, perhaps even spanning the entire wall of the structure or the entire wall of a room in the structure. As noted, the device may also be incorporated into a door, a window, a floor, or a ceiling of the structure.

It will be appreciated that the illustrative moisture control system or device requires no power to control moisture and no control system. Rather, it is a mechanical device that is "on" generally when the relative humidity in a structure above about 50% at which time water vapor will condense on the collector unit until equalibrium is reached and the relative humidity returns to about 50% or below, at which time water vapor will stop condensing and thereby turning the system "off." Also, the more water present in the structure, whether in the form of water vapor in the air or liquid water in the structural components of the structure, the more water the collector element will remove. Still, electrical power could be used, either to change the collector element's vertical or horizontal position in the structure, or to make the collector element colder relative to other structural components.

These and other aspects of the present invention will become more apparent from the following description of the illustrative embodiment.

DESCRIPTION OF THE ILLUSTRATIVE EMBODIMENTS

Figure 1:
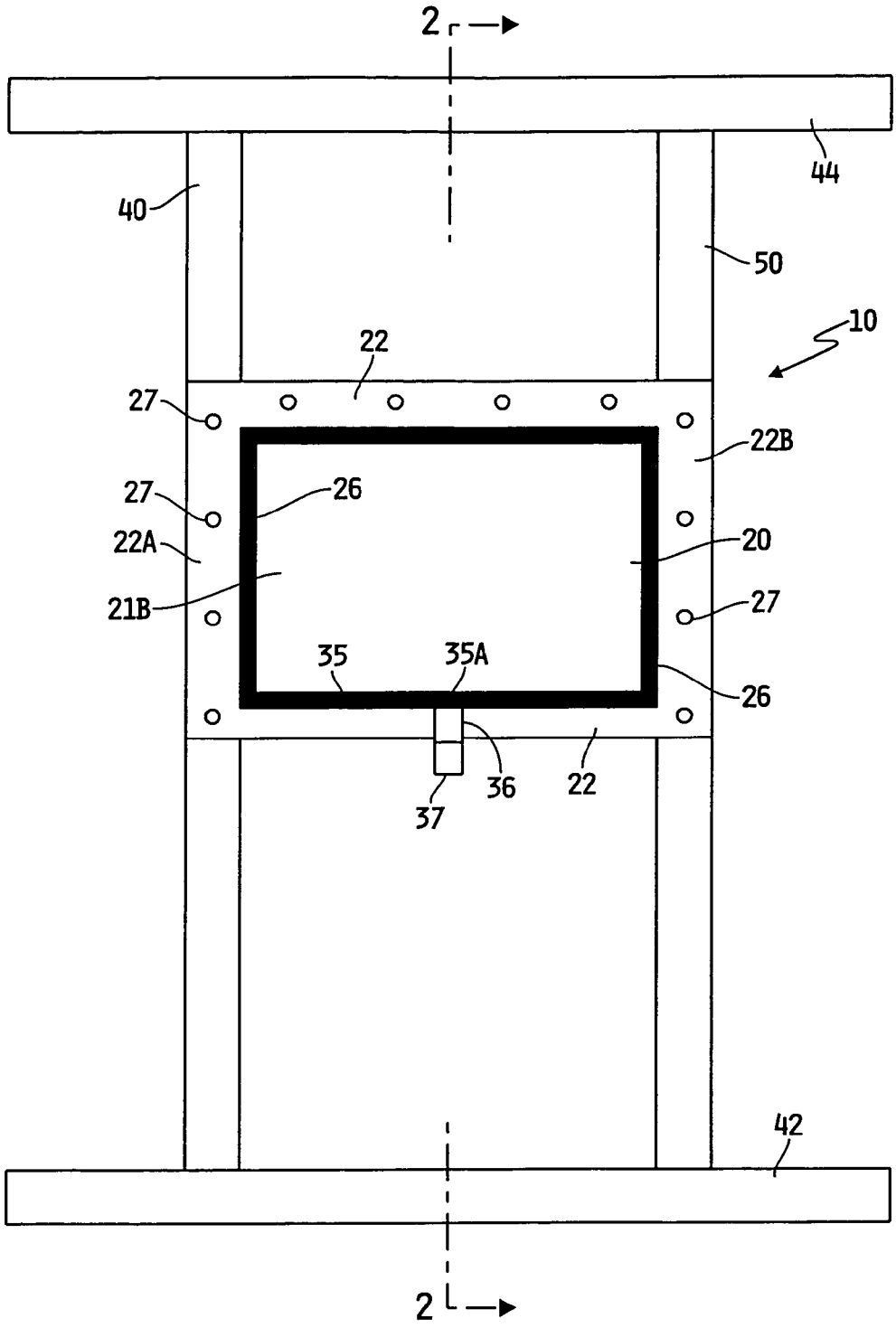
FIG. 1 is a front elevation view of an illustrative embodiment of a moisture control system.

For the purposes of promoting an understanding of the principles of the invention, reference will now be made to a number of illustrative embodiments illustrated in the drawings and specific language will be used to describe the same.

Figure 2:
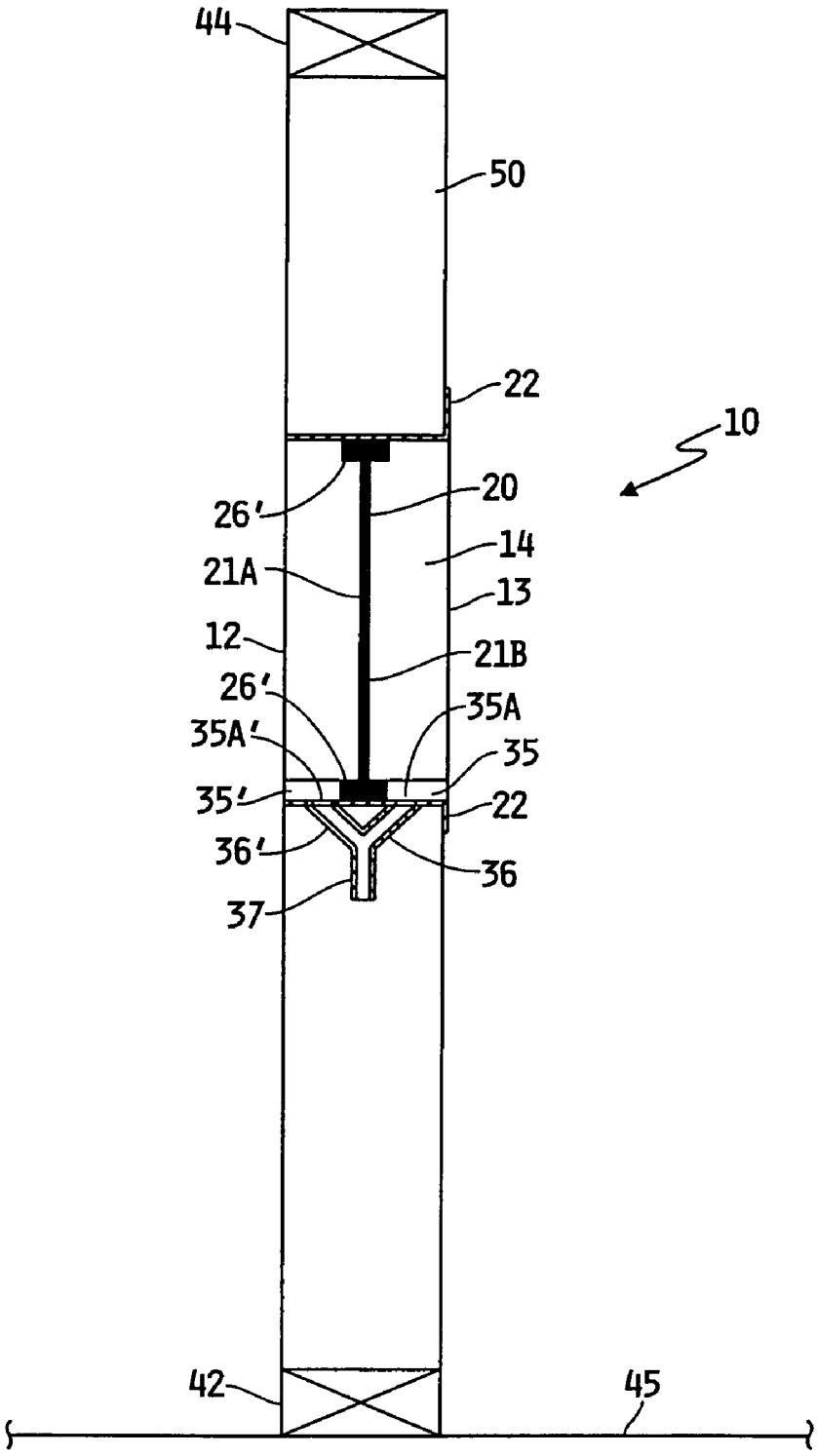
FIG. 2 is a sectional view of the system of FIG. 1 taken generally along the line 2-2 in FIG. 1.

FIGS. 1-2 illustrate a preferred embodiment of a moisture condensation control system or device 10. The moisture condensation control system 10 can be incorporated into any suitable structural component or portion of a structure including for example and without limitation a door, a wall, a ceiling, a floor, a window, the basement, or the roof of the structure in order to control moisture condensation on and within the structure.

In the illustrative case where the control system 10 is installed or attached to the wall of a structure, the structure's stud wall section or frame generally includes a base stud plate 42 extending along and secured to, the floor joist(s) 45 of the structure and a plurality of studs that extend vertically between, and are secured at their ends to, the base stud plate 42 and the ceiling stud plate 44. The stud wall frame as generally described is of conventional type and the construction thereof will be apparent to those in the art from the description herein.

The illustrative control system or device 10 is installed, assembled within or attached to the vertical stud frame as shown and described herein. Illustratively, a collector element 20 is selectively positioned between a first vertical stud 40 and a second vertical stud 50. The collector element 20 having a rear, reverse or exterior side 21A that may be in temperature communication with the structure's exterior ambient atmosphere, and an opposing front, obverse or interior side 21B that may be in temperature communication with the structure's interior ambient atmosphere. Only one surface 21A, 21B need necessarily be in temperature communication with its respective ambient atmosphere. Namely, the surface 21A, 21B that is proximate to whichever ambient atmosphere, interior or exterior, is the coldest relative to the other, is the surface 21A, 21B that should be in temperature communication with that surface's respective ambient atmosphere. Material such as a wall, drapery or other cloth, cover, insulation, sheathing or the like 12, 13 may overlie the studs 40, 50 facing away from the interior of the structure and/or facing inwardly toward the interior of the structure. Such walls or sheathing 12, 13 may, but need not, also overlie one or both of the sides 21A and 21B. As such, while it is understood the system 10 is constructed apart of the structure's wall stud section, illustratively the exterior side 21A of the collector element 20 may be in fluid or air flow and/or temperature communication with the exterior of the structure or of a portion thereof, and the interior side 21B of the collector element 20 may be in fluid or air flow and/or temperature communication with the interior of the structure. It will be appreciated that the exterior side 21A could be in temperature communication to the ambient atmosphere outside the structure, or just to the inside ambient atmosphere of a particular portion of the structure, such as a room of the structure. For example and without limitation, the exterior side 21A could be adjacent to and in communication with a garage, a covered porch, a crawl space, a basement, an entryway or a utility room, so long as such ambient atmosphere adjacent to the back side 21A is relatively colder than the ambient atmosphere adjacent to the front side 21B.

Means for attaching the collector element to the structure may be attached to the collector element 20. For example, the collector element 20 may be encased in a frame 14 (FIG. 1) constructed of any suitable material, and configured to be attached to any suitable structural component of the structure. Illustratively, such a frame 14 may extend around the entire perimeter or periphery of the collector element 20, and may, for example, be attached directly to the studs 40, 50. In another example, a flange 22 may be attached either directly to the collector element 20 or to at least a portion of the frame 14. As shown, the flange 22 illustratively may extend around the entire periphery or perimeter of the collector 20. In another example, a flange 22A and 22B may be attached to opposing vertical sides of the system 10, whether to the frame 14 or to the collector element 20. In such a case, first flange 22A appropriately may be attached to the first vertical stud 40 using attaching means 27 known in the art, and second flange 22B may be appropriately attached to the second vertical stud 50 using attaching means 27. As noted, 22A and 22B could form part of a continuous flange 22. Illustrative attaching means 27 may include for example and without limitation nails, staples, screws, rivets, glue, cement, hook and loop and the like and any combination thereof. Such attaching means 27 alone or in any combination may be used to attach the frame 14 to the collector element 20 and/or to the vertical studs 40, 50, or to connect the flange(s) 22, 22A, 22B to the frame 14, the collector element 20, and/or to the studs 40, 50. So too if the collector element is attached to a door, a window, a floor, or a ceiling, such illustrative attaching means 27 may be used.

Illustratively, a generally fluid-tight seal 26 is disposed between the frame 14 and the collector element 20; or, if no frame is used, then between the flange 22 and the collector element. Such a seal 26 may, but need not be used on both sides 21A, as in seal 26', and 21B, as in seal 26, of the collector element. Whether the seal is on one or both sides for the collector element, the seal(s) 26, 26' prevents fluid, such as for example air or water, from the exterior of the structure from communicating with the interior side 21B of the collector element 20, and further prevents fluid from the interior of the structure from communicating with the exterior side 21A of the collector element 20. As noted, it will be appreciated that the flange 22, or other suitable attachment means, may be connected directly to the collector element 20 rather than to the frame 14. Further, in addition to, or in lieu of the frame 14 and/or the flange 22, it will be appreciated that other means for attaching the collector unit to the structure may be used.

As shown in FIG. 2, the frame 14 illustratively defines a first collection reservoir 35 configured to receive any fluid, such as water, that has condensed on and rolled off of the front surface 21B of the collector element 20. The frame illustratively defines a second collection reservoir 35' configured to receive any fluid, such as water, that has condensed on and rolled off of the back surface 21A of the collector element 20. The collection reservoir(s) 35, 35' may be removable so that the collected moisture may be emptied. In another embodiment, a drain opening 35A, 35A' may be defined by the frame 14 and/or by the respective reservoir(s) 35, 35' and may be in fluid communication with a respective drain path or channel 36, 36' designed to control and direct any moisture rolling off of the collector element 20 away from the collector element 20. The drain path or channel(s) 36, 36' may alone empty directly into a septic or sewer system (not shown), directly onto the ground outside the structure, or into a container as desired. It will be appreciate that drain path or channel 36 is configured for exfiltration and drain path 36' is configured for infiltration. As best shown in FIG. 1, the drain paths or channel 36, 36' can merge into a single drain path or channel 37, or they can each have a dedicated drain path or channel (not shown). One or more of the drain channel(s) 36, 36', 37 could be in direct fluid communication with the collector element 20, thereby eliminating the need for a reservoir(s) 35, 35'.

Although the illustrative embodiment depicts the collector element 20 placed generally half-way between the base stud plate 42 and the ceiling stud plate 44, those skilled in the art will appreciate that the collector element 20 could be placed anywhere between the stud plates 42, 44. For example and without limitation, the collector element 20 could be placed adjacent the base stud plate 42 near the floor of the structure, adjacent the ceiling stud plate 44 near the ceiling of the structure, or even extend from the base stud plate 42 to the ceiling stud plate 44. In addition, as noted the collector element 20 may be placed in any other suitable portion of the structure, for example and without limitation, a door, a ceiling, a roof, a floor, or a window of the structure. It should also be appreciated that the collector element 20 could be installed in a reverse orientation such that surface 21B is proximate to the exterior of the structure, to the left in FIG. 2, and surface 21A is proximate to the interior of the structure, to the right in FIG. 2.

While experiments have shown that collector element 20 will operate properly whether placed at the top or the bottom of the structure, especially good results have been obtained when the collector element is placed closer to the ceiling, or when it is coextensive with the height of the wall cavity. In addition to the collector element 20 being able to be installed anywhere vertically along the wall of the structure, it can also be installed anywhere between the interior and exterior walls or coverings 12, 13. Testing has shown that having an air gap between the surfaces of the collector unit and any material 12, 13 placed in front of the collector element 20 increases the efficiency of the collector element 20. For example, an air gap between the collector element and the insulation in the structure's wall cavity, or the wall, sheathing or other covering, allows the moisture in the insulation or wall, to more efficiently move toward the collector element 20. Such gaps may measure between about 2.5 mm and 9.5 mm; and are preferably about 9.0 mm from the cold surface. In any event, it is desirable to place the collector element 20 closest to whichever material or wall 12, 13 that is colder relative to the other wall 12, 13 in the structure. For example and without limitation, the collector element should be closer to the external wall 12 when the outside ambient atmosphere is colder relative to the ambient atmosphere inside the structure and vice versa. As noted, the collector element surfaces 21A, 21B should have relatively low surface tension and should not be so thick as to create thermal resistance to the collector element The thermal resistance of the collector element should be minimal relative for the total resistance of the structure's other construction such as walls, windows, ceilings, floors, and doors.

Those skilled in the art will appreciate that the collector element may be adjustable horizontally to any desired location between the coverings 12, 13. The position of the collector element 20 between the coverings 12, 13 could be accomplished manually or mechanically. For example, slots could be provided along the frame 14 between coverings 12, 13 and a user could take the collector element 20, and seal, out of one slot and move it to another slot, closer to covering 13 for example. In another embodiment, a system of gears and tracks could be used to "crank" or move the collector element 20 towards or away from the coldest covering 12, 13. Such movement may be added by an electric motor. Of course there need not be any covering 12, 13, at all, in front of the collector element 20. So too, the collector element 20 could be repositioned vertically using an electrical and/or mechanical system.

The collector element 20 could be made from any suitable metallic, non-metallic, or composite material such as for example and without limitation copper, steel, glass, ceramic, and the like, so long as it is more conducive to attracting water vapor and inducing condensation as described herein than the structure's other structural components. The collector element 20 may be decorative in that it may come in different colors, may have designs attached, etched or embossed thereon, and the like. The collector element 20 may also be placed behind a suitable covering 12, 13 as noted, such as a screen, wall, sheathing, cover, insulation or other structure, so long as the collector element 20 remains in fluid or temperature communication with the interior of the structure and the exterior of the structure or portion thereof. A thermal bridge (not shown) may need to be used as described. It will also be appreciated that while the illustrative embodiments have a collector element that passively attracts water vapor and encourages or induces condensation thereof on the surface of the collector element, it is also contemplated that the collector element 20 could be made even colder, such as by providing a refrigerant system, as through the use of electricity, or material, such as ice, in order to better attract and condense water vapor. Multiple control systems 10 could be used throughout a structure if desired. Finally, although the illustrative embodiments are generally planar, they may also be curvate.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. Thus the scope of the invention should be determined by the appended claims in the formal application and their legal equivalents, rather than by the examples given.

What is claimed is:

1. A moisture condensation control system for use in a building structure, the moisture condensation control system comprising:

a building structure having a stud frame, a floor, and a ceiling, connected to one another, the stud frame including a first stud and a second stud;

a covering, the covering and the stud frame being attached to one another;

a passive collector element having opposing front and rear surfaces encased in a collector frame and including a flange attached to the collector frame, and a seal interspersed between the collector frame and at least one of the front and rear surfaces;

a drainage system in fluid communication with the collector element, the drainage system comprising a moisture collection reservoir in fluid communication with the collector element and a channel in fluid communication with the reservoir;

wherein the passive collector and the stud frame are connected to one another, and wherein the passive collector is selectively positioned between the ceiling and the floor, and wherein the passive collector is selectively positioned between the first stud and the second stud to define an air gap ranging from about 0.0 centimeters to about 3.0 centimeters between the covering and at least one of the front and rear surfaces; and wherein the passive collector induces condensation thereon without the aid of any man-made power source; and wherein the building structure is chosen from the list of building structures consisting of an office building, a residential building, a commercial building, an industrial building, a house, a dwelling, a garage, a warehouse, a barn, a shed, a factory, a medical building, a hospital, a laboratory, a recreational building, a sports arena, a natatorium, a greenhouse, a treehouse, and a hangar.

2. The moisture condensation control system of claim 1 wherein the building structure comprises an office building.

3. The moisture condensation control system of claim 1 wherein the building structure comprises an residential building.

4. The moisture condensation control system of claim 1 wherein the building structure comprises an commercial building.

5. The moisture condensation control system of claim 1 wherein the building structure comprises an industrial building.

6. The moisture condensation control system of claim 1 wherein at least one of the front and rear surfaces comprises substantially a metallic material.

7. The moisture condensation control system of claim 6 wherein the metallic material is chosen from the list of metallic materials consisting of copper, steel, iron, tin, aluminum and brass.

8. The moisture condensation control system of claim 1 wherein at least one of the front and rear surfaces comprises substantially a non-metallic material.

9. The moisture condensation control system of claim 8 wherein the non-metallic material is chosen from the list of non-metallic materials consisting of plastic, ceramic, and glass.

10. The moisture condensation control system of claim 1 wherein at least one of the front and rear surfaces comprises substantially a composite material.

11. The moisture condensation control system of claim 1 wherein the passive collector element is generally planar.

12. The moisture condensation control system of claim 1 wherein the passive collector element is adjustable to vary the air gap between the covering and at least one of the front and rear surfaces.

13. The moisture condensation control system of claim 1 wherein the air gap measures between about 2.5 mm and about 9.5 mm between the covering and at least one of the front and rear surfaces.

14. The moisture condensation control system of claim 1 wherein the air gap measures about 9.0 mm between the covering and at least one of the front and rear surfaces.

15. The moisture condensation control system of claim 1 wherein the covering is chosen from the list of coverings consisting of a wall, an insulation material, a cover, and a decoarative cover.

16. The moisture condensation control system of claim 1, further comprising at least one structural element to which the moisture control system is attached, and wherein the at least one structural element is chosen from the list of structural elements consisting of the ceiling, the floor, a door, a wall, and a window, and wherein the passive collector element has higher thermal conductivity properties than the at least one structural element of the structure to which the moisture control system is attached.

17. The moisture condensation control system of claim 1 wherein the passive collector element has lower thermal resistance properties than the at least one structural element of the structure to which the mosture control system is attached.

18. The moisture condensation control system of claim 1 wherein the passive collector element has higher heat transmission properties than the windows or walls of the structure.

19. The moisture condensation control system of claim 1 wherein the drainage system comprises a first channel in fluid communication with the front surface and a second channel in fluid communication with the rear surface; the first and second channels being in fluid communication with a third channel; and wherein the frame defines a drain opening into the drainage system.

20. The moisture condensation control system of claim 1 wherein the rear surface of the passive collector element is positioned generally proximate to an area of the building structure that has a colder ambient temperature relative to an ambient temperature of an area of the building proximate to the front surface of the passive collector element.

* * * * *